US008499530B2

(12) United States Patent
Fisher et al.

(10) Patent No.: US 8,499,530 B2
(45) Date of Patent: Aug. 6, 2013

(54) BOX CLOSING APPARATUS

(75) Inventors: Joseph M. Fisher, Depew, NY (US); Timothy J. Green, North Tonawanda, NY (US); William B. Elliott, Aiden, NY (US); Eric Spina, Eden, NY (US)

(73) Assignee: Illinois Tool Works, Glenview, IL (US)

( * ) Notice: Subject to any disclaimer, the term of this patent is extended or adjusted under 35 U.S.C. 154(b) by 387 days.

(21) Appl. No.: 12/752,618

(22) Filed: Apr. 1, 2010

(65) Prior Publication Data

US 2010/0251670 A1 Oct. 7, 2010

Related U.S. Application Data

(60) Provisional application No. 61/165,667, filed on Apr. 1, 2009.

(51) Int. Cl.
*B65B 7/00* (2006.01)
*B65B 7/16* (2006.01)

(52) U.S. Cl.
USPC ..... 53/376.4; 53/491; 53/376.2; 53/376.5

(58) Field of Classification Search
USPC ..... 53/376.4, 376.5, 377.2, 377.4, 377.6, 53/378.3, 491
See application file for complete search history.

(56) References Cited

U.S. PATENT DOCUMENTS 3,045,408 A * 7/1962 Rasmusson ..... 53/377.2
3,107,469 A * 10/1963 Mosse et al. ..... 53/378.3
3,397,509 A * 8/1968 Ullman ..... 53/285
3,513,616 A * 5/1970 Davis ..... 53/415
3,831,342 A * 8/1974 Rejsa ..... 53/491
4,265,355 A 5/1981 Davis
4,969,305 A 11/1990 York et al.
5,168,883 A 12/1992 Winn
5,426,921 A * 6/1995 Beckmann ..... 53/566
5,657,855 A 8/1997 Ferguson
5,809,752 A * 9/1998 Holbrook ..... 53/569
5,863,380 A * 1/1999 Gambetti ..... 156/443
6,226,965 B1 * 5/2001 Lam ..... 53/491
7,140,164 B2 * 11/2006 Fietkau ..... 53/377.4
7,216,468 B2 * 5/2007 Goodman ..... 53/491
7,371,298 B2 5/2008 Michalski et al.
7,437,860 B2 10/2008 Brandow et al.
7,506,485 B2 3/2009 Quinn et al.
7,571,587 B2 * 8/2009 Goodman ..... 53/377.3
2003/0116285 A1 6/2003 Michalski et al.
2004/0045660 A1 3/2004 Chojnacki
2004/0045676 A1 3/2004 Chojnacki
2005/0091944 A1 * 5/2005 Goodman ..... 53/491
2007/0214745 A1 9/2007 Quinn et al.
2007/0215261 A1 9/2007 Quinn et al.
2007/0215263 A1 9/2007 Quinn et al.
2008/0060320 A1 3/2008 Quinn et al.

* cited by examiner

*Primary Examiner* — M. Alexandra Elve
*Assistant Examiner* — Eyamindae Jallow
(74) *Attorney, Agent, or Firm* — Leydig, Voit & Mayer, Ltd.

(57) ABSTRACT

An apparatus for closing flaps of a rectangular cuboid includes a pair of first flap closing guide members to guide a first flap from an open position to a closed position. A pair of second flap diverting members divert a second flap away from engaging the first flap closing guide members and a pair of second flap closing guide members that guide the second flap from an open position to a closed position. A machine having the closing apparatus and a method of closing a rectangular cuboid are also included.

20 Claims, 12 Drawing Sheets

BOX CLOSING APPARATUS

CROSS-REFERENCE TO RELATED APPLICATIONS

This patent application claims the benefit of U.S. Provisional Patent Application No. 61/165,667, filed Apr. 1, 2009, which is incorporated by reference.

BACKGROUND OF THE INVENTION

The present invention generally relates to an apparatus for closing boxes and, more particularly, to an apparatus for closing the flaps of asymmetrical boxes that are fed in either of two orientations.

It is often desirable to automate manufacturing processes that require significant amounts of labor or are highly repetitive. However, some processes are more difficult to automate due to the configuration of the products being processed. In particular, products that are not uniform or are asymmetrical present unique problems during the automation process. Further, components that appear to be symmetrical but in fact are asymmetrical present even more difficulties.

One example of a product that appears to be symmetrical but in fact is asymmetrical is cigarette carton. Each carton typically has a rectangular or cuboid shape with two long sides connected by two ends with a top surface integrally formed with and connected to the two side surfaces. The bottom of the carton is formed by a first relatively wide or large flap that extends along the entire length of one of the sides and with a width equal to that of the top surface of the carton and a second narrow or small flap that extends along the entire length of the other side and which has a width equal to that of only one third to one half of the width of the carton.

Revenue or tax stamps must be applied to individual packs of cigarettes and, because the taxes and stamps vary by state, county and even by city, these stamps are not applied to the packs until they reach their final destination. However, for ease of handling, cigarette packs are packaged in the cartons in which they will ultimately be sold or displayed and then the cartons are packaged in relatively large boxes that are shipped to the desired location. Once the boxes of cigarettes reach the destination at which the revenue stamps will be applied, the boxes are opened and the cartons removed from the boxes. The cartons are then opened, tax stamps applied and the cartons re-sealed. As a result, care must be taken to not tear or damage the cartons when opening them during the process of applying the revenue stamps so that they may be re-sealed and subsequently re-shipped.

During the packaging process at the cigarette factory, after the cigarette packs are loaded into a carton, a small amount of adhesive or glue (typically two drops) is applied to the narrow flap and then the wide flap is rotated or pivoted onto the narrow flap in order to temporarily seal the carton to facilitate shipping to the location at which the revenue stamps are applied. The temporarily sealed cartons are then loaded into boxes for shipping.

Once the boxes of cigarettes reach the destination at which the revenue stamps will be applied, the boxes are opened and the cartons removed from the boxes. One current automated revenue stamping machine utilizes an asymmetrical opener or plow which requires that the cigarette cartons be loaded therein with the temporarily sealed bottom surface facing upward and with the wide and narrow flaps that form the bottom surface oriented in a specific direction (i.e., with the wide flap to the left). An asymmetrical structure is then used to close the flaps after the revenue stamps have been applied.

Since the cartons are rectangular or cuboid shaped, there are four possible orientations that will initially appear to be identical without close inspection. More specifically: 1) top up, wide flap left; 2) top up, wide flap right; 3) bottom up, wide flap left; and 4) bottom up, wide flap right. With the current automation equipment, if the cigarette cartons are not loaded into the equipment in the one correct orientation, the automation equipment cannot open and subsequently close the cartons.

BRIEF SUMMARY OF THE INVENTION

An apparatus for closing flaps of a rectangular cuboid includes a pair of first flap closing guide members to guide a first flap from an open position to a closed position. A pair of second flap diverting members divert a second flap away from engaging the first flap closing guide members and a pair of second flap closing guide members that guide the second flap from an open position to a closed position.

The first and second flap closing guide members of the apparatus may be curvilinear. The first flap closing guide members may be mirror images of each other relative to a central axis of the drive path. The first flap closing guide members may be laterally aligned along the drive path. The second flap diverting members may extend in a sloped manner relative to the drive path. The second flap closing guide members may be mirror images of each other relative to a central axis of the drive path. The second flap closing guide members may be offset along the drive path. The pair of second flap diverting members, the pair of first flap closing guide member and the pair of second flap closing guide members may be sequentially positioned along the drive path. The first flap closing guide members may be movably mounted to permit lateral movement thereof in opposite directions relative to drive path to adjust for cuboids having different lateral widths. The second flap diverting members may be laterally movable with the first flap closing guide members.

The apparatus may include a biasing member to bias the first flap closing guide members towards a centerline of the drive path. The apparatus may include a pair of ramps coupled to the first flap closing guide members. The pair of ramps may be movably mounted on opposite sides of drive path and configured to engage the first and second oppositely facing side surfaces of the cuboid to appropriately position the first flap closing guide members based upon the lateral width of the cuboid. The pair of first flap closing guide members and the pair of second flap diverting guide members may be symmetrical about the drive path.

A machine may be provided for processing a rectangular cuboid that includes a transport mechanism for moving the cuboid along a drive path and an opening station for displacing first and second flaps of the cuboid from a first sealed position to open the cuboid to provide access to articles within the cuboid. An indicia applying station applies indicia to the articles within the cuboids and a closing station having a pair of first flap closing guide members, a pair of second flap diverting members and a pair of second flap closing guide members. Portions of the first flap closing guide members are located on opposite sides of the drive path and are configured to guide a first flap from a first flap open position spaced to a first flap closed position generally adjacent the first sealed position. Portions of the second flap diverting members are located on opposite sides of the drive path and are configured to divert a second flap away from the first flap closing guide members. Portions of the second flap closing guide members are located on opposite sides of the drive path and are configured to guide a second flap from a second flap open position to a second flap closed position generally adjacent the first sealed position.

The machine may further include adhesive applying nozzles positioned along the drive path between the first and second flap closing guide member. The opening station, the indicia applying station and the closing station may be sequentially positioned along the drive path. The machine may further include a sensor mechanism for determining the orientation of the first flap.

A method may be provided for processing a rectangular cuboid including providing first and second rectangular cuboids. A closing apparatus is provided along a drive path to move each flap of the cuboid from an open position to a closed position to close an open face of the cuboid. The first cuboid is oriented in a first orientation with the longitudinal axis thereof being parallel to the drive path of the cuboid and with a first side of the first cuboid being positioned in a first direction relative to the drive path and the open face being oriented in a second direction relative to the drive path. The second cuboid is oriented in a second orientation with the longitudinal axis thereof being parallel to the drive path, a first side of the second cuboid being positioned in a third direction relative to the drive path and an open face of the cuboid being oriented in the second direction relative to the drive path, the first direction being opposite to the third direction. The first cuboid is moved relative to the closing apparatus along the drive path so that the closing apparatus engages the first and second flaps of the first cuboid to close the first cuboid. The second cuboid is moved relative to the closing apparatus along the drive path so that the closing apparatus engages the first and second flaps of the second cuboid to close the second cuboid. A step of applying indicia to articles within the first and second cuboids before the moving steps may be provided. A step of applying adhesive to the first flap of the first and second cuboids after the first flap has been closed but before the second flap has been closed may be provided.

BRIEF DESCRIPTION OF THE DRAWINGS

Various other objects, features and advantages of the present invention will become more fully appreciated and better understood when considered in conjunction with the accompanying drawings wherein like-referenced characters designate the same or similar parts throughout the several views in which.

DETAILED DESCRIPTION OF THE PREFERRED EMBODIMENT

The following description is intended to convey the operation of exemplary embodiments of the invention to those skilled in the art. It will be appreciated that this description is intended to aid the reader, not limit the invention. As such, references to a feature or aspect of the invention are intended to describe the feature or aspect of the embodiment of the invention, not to imply that every embodiment of the invention must have the described characteristic.

Figure 1:
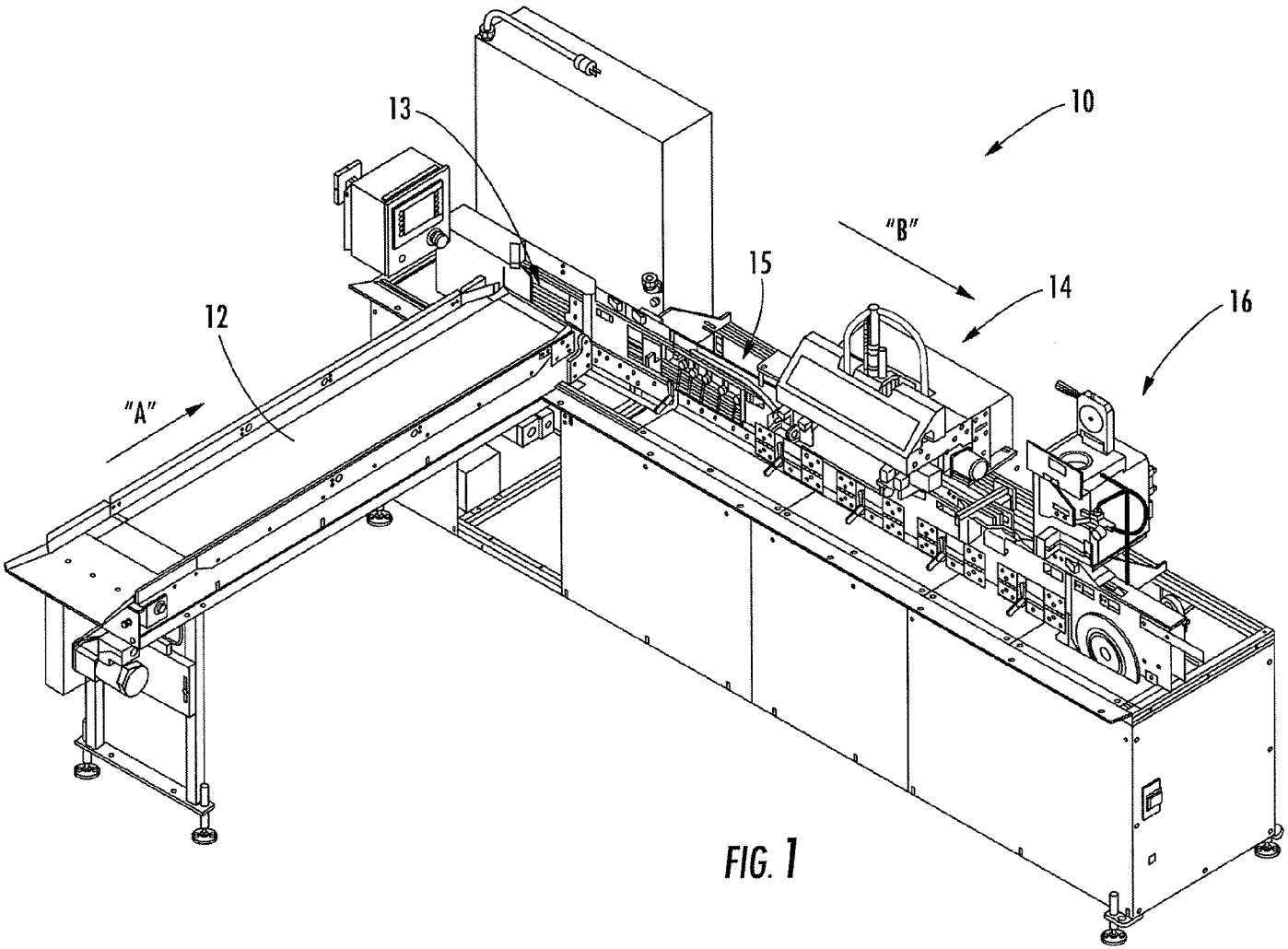
FIG. 1 is a perspective view of a revenue stamp applying machine including the box closing member of the present invention.

Referring to FIG. 1, revenue stamp applying machine 10 includes a feed conveyor 12 onto which cigarette cartons 20 (FIG. 3) are loaded and then moved laterally or perpendicular (in the direction of arrow "A") relative to the longitudinal axes of the cigarette cartons. Drive conveyor 13 is provided to move cartons 20 sequentially along a linear or drive path "B" from the feed conveyor 12 towards stamp head 14 at which revenue stamps are applied. Prior to reaching stamp head 14, the carton 20 is opened by carton opening member or plow 15 which contacts the flaps 27, 28 that form the top wall of carton 20 in order to de-laminate the bottom surface of the carton formed by the two flaps. As the cigarette carton moves past opening member 15 (from left to right as viewed in FIG. 1), the flaps are opened sufficiently wide in order to permit the revenue stamps to be applied to the bottom (upwardly facing in FIGS. 2-9) of each pack of cigarettes (not shown). After opening carton 20 and applying revenue stamps to the cigarette packs, drive conveyor 13 moves each carton along linear path "B" towards flap closing and glue applying apparatus 16 which is located downstream from stamp head 14. Drive conveyor 13 moves each carton 20 past closing and glue applying apparatus 16 that first closes or deflects the narrow flap 28 back to its closed position, glue is applied to the narrow flap and then the wide flap 27 is closed or deflected back to its closed position on top of narrow flap 28 in order to re-seal the top of each carton 20. The re-sealed cartons 20 are then removed from machine 10 and may be returned to the boxes in which they were originally shipped or some other box or container as desired.

In this description, representations of direction such as up, down, left, right, front, rear and the like used for explaining the structure and movement of each part of the disclosed embodiments are not absolute, but relative. These representations are appropriate when each part of the disclosed embodiment is in the position shown in the Figures. If the position of the disclosed embodiment changes, these representations are to be changed according to the change in the position of the disclosed embodiment.

Figure 2:
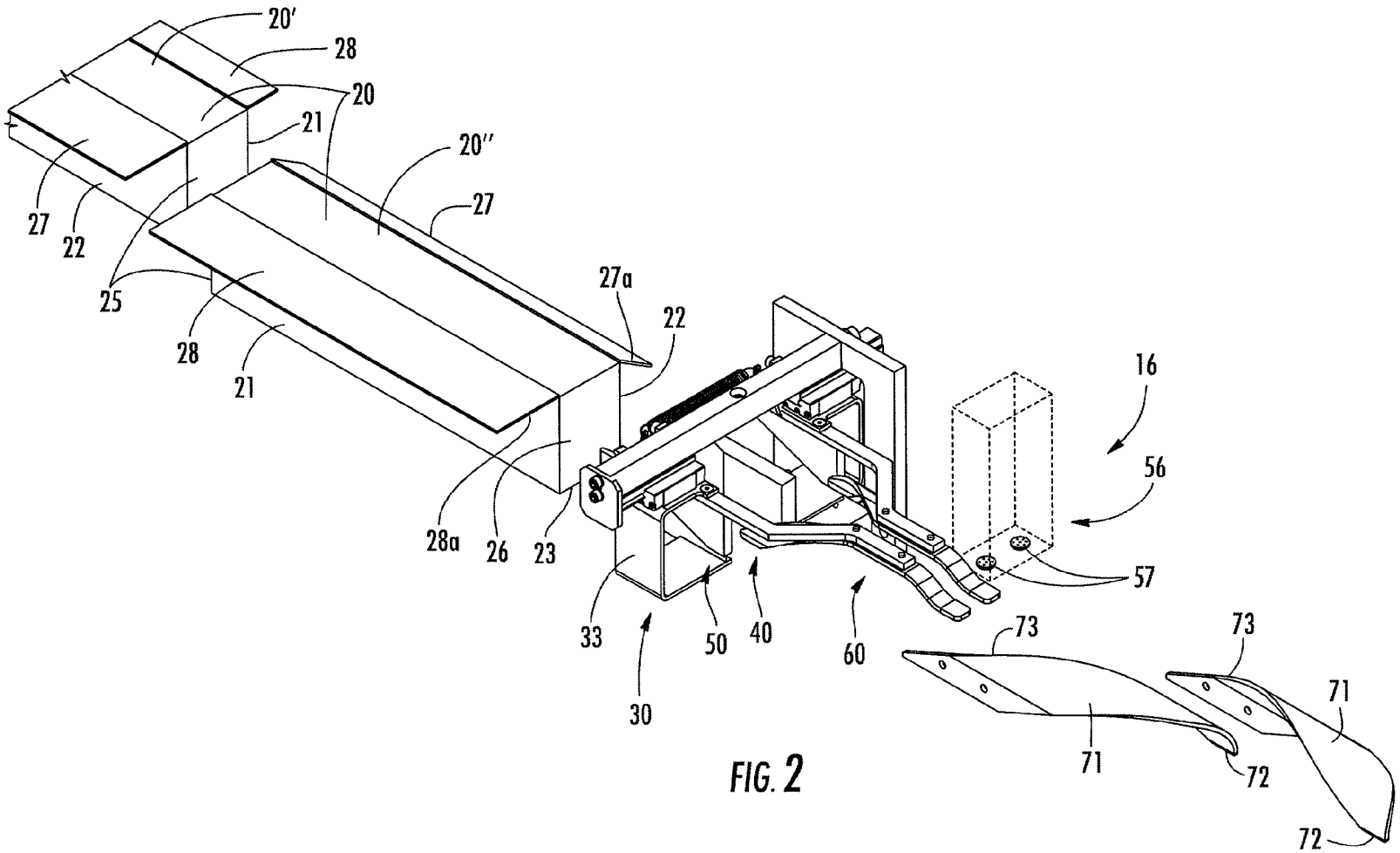
FIG. 2 is a perspective view of the flap closing and glue applying apparatus of FIG. 1 prior to a carton engaging the apparatus.
Figures 3, 11:
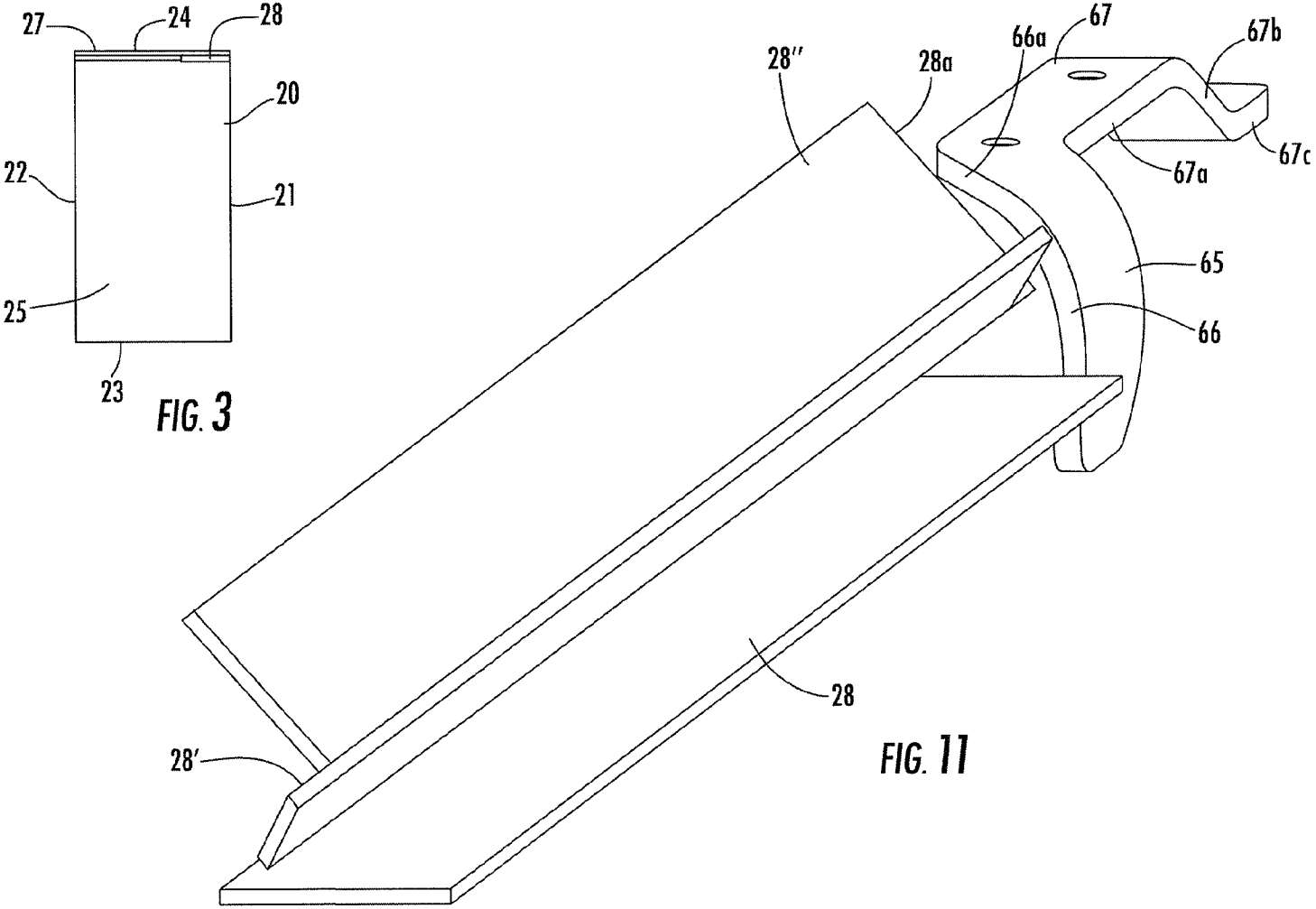
FIG. 3 is an end view of a carton in a closed condition.
FIG. 11 is an enlarged perspective view of the narrow flap closing guide with a narrow flap shown in various angular orientations.

Referring to FIGS. 2 and 3, carton 20 is a rectangular cuboid with a pair of elongated oppositely facing sidewalls 21, 22 that are interconnected by a bottom wall or surface 23, an oppositely facing top wall or surface 24 and a pair of oppositely facing end walls or surfaces 25 and 26. Bottom wall 23 is integrally connected and extends from sidewalls 21 and 22. End walls 25 and 26 as well as top wall 24 are formed by folding over flaps that extend from each sidewall 21, 22 and gluing them or otherwise adhering them together. More specifically, top wall 24 is formed by a combination of wide or large flap 27 that extends from sidewall 22 and narrow or small flap 28 that extends from sidewall 21. Accordingly, opening flaps 27, 28 provide access to the interior of carton 20. Flaps 27, 28 are depicted in an open position in phantom in FIG. 3 to show their relative size difference.

During the manufacturing process, after the cigarette packs (not shown) are loaded into the cartons, the narrow flap 28 is folded down so as to be perpendicular to sidewall 21. A small amount of adhesive or glue (not shown) is applied to narrow flap 28 and then wide flap 27 is folded down so as to be perpendicular to sidewall 22 and engage the adhesive on narrow flap 28 to create the laminated structure (FIG. 3) that forms top wall 24. Two circular drops of adhesive are typically applied to narrow flap 28 in order to temporarily secure wide flap 27 and narrow flap 28 together during the initial transportation of the packs of cigarettes prior to the application of the revenue stamps to the bottom of the cigarette packs. End walls 25 and 26 are similarly formed with wide and narrow flaps although only the wide flaps can be seen as the visible portion of end walls 25 and 26. In addition, since end walls 25, 26 are not intended to be temporarily secured, the wide and narrow flaps that form end walls 25 and 26 are secured using a standard elongated length of adhesive or glue rather then a small amount as is used with wide flap 27 and narrow flap 28. It should be noted that cartons 20, as depicted in FIGS. 2 and 3, are actually upside down with the actual top surface of carton 20 being bottom wall 23 and the bottom surface of carton 20 being top wall 24. Carton 20 is inverted during the process of applying the revenue stamps as such stamps are adhered to the bottom of each pack of cigarettes.

Figure 4:
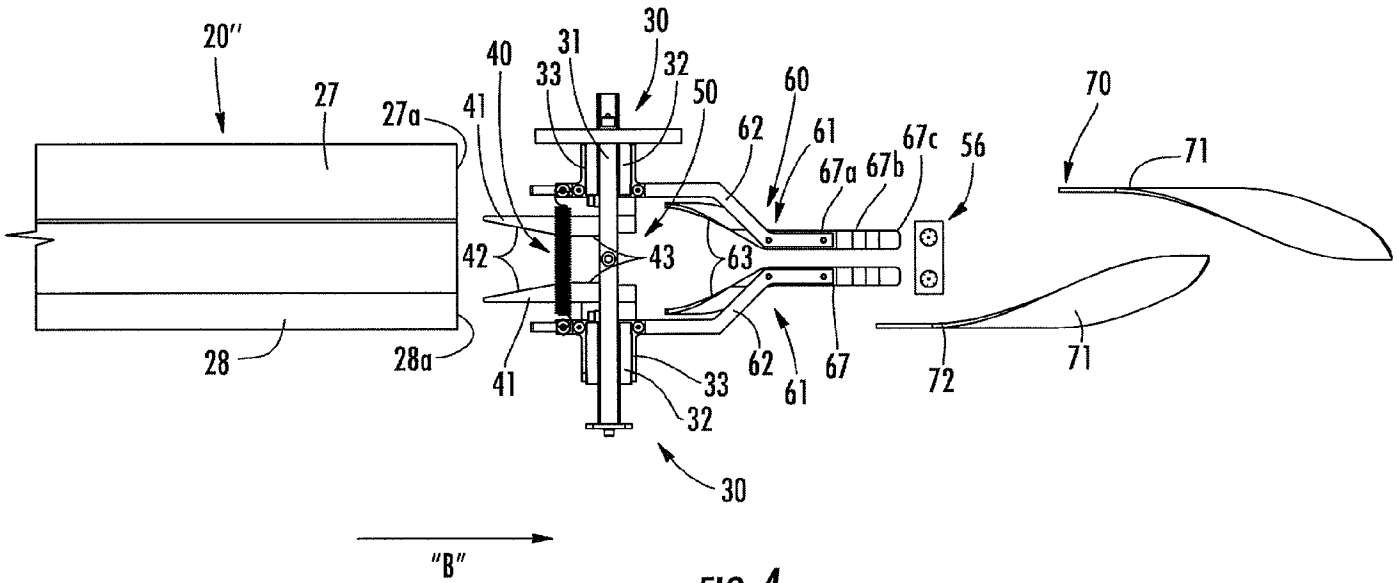
FIG. 4 is a enlarged top plan view of the flap closing and glue applying apparatus in the position depicted in FIG. 2.
Figure 5:
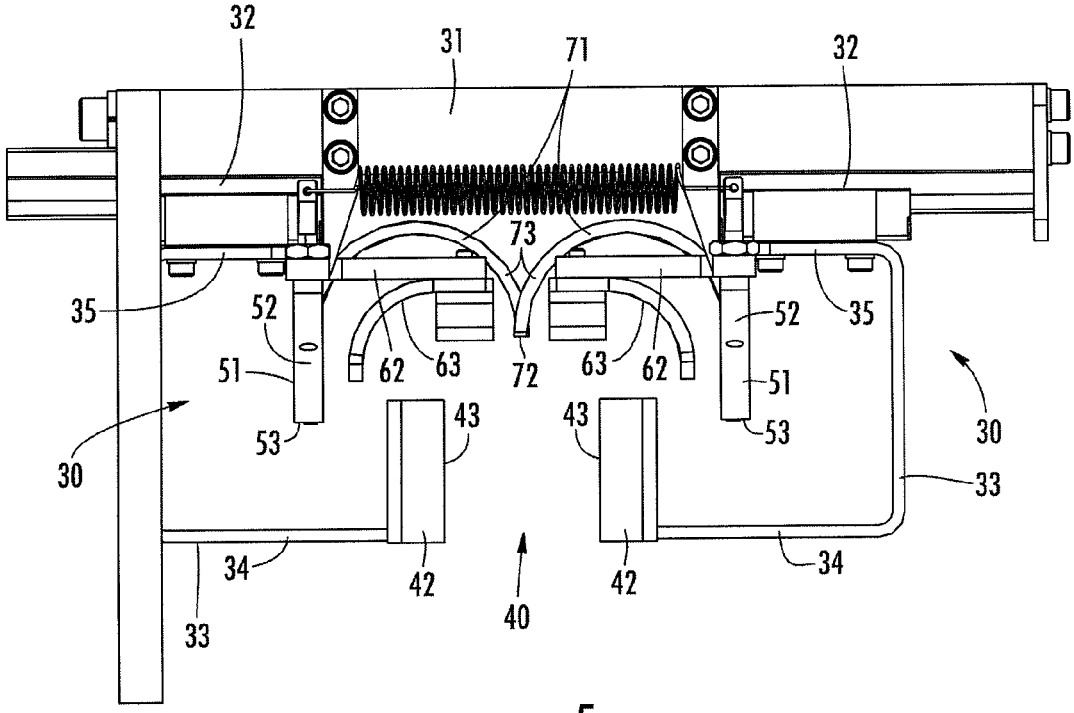
FIG. 5 is an end view of the flap closing and glue applying apparatus in the position depicted in FIG. 2 with the cartons removed.

As described above, the cartons are opened by a carton opening member 15 and the revenue stamps applied by stamp head 14. The cartons then pass by flap closing and glue applying apparatus 16 in order to close or re-seal the cartons. Referring to FIGS. 2, 4, 5, closing and glue applying apparatus 16 includes width adjustment station 40, wide flap deflecting station 50, narrow flap closing station 60, glue station 56 and wide flap closing station 70 that are sequentially positioned along drive path "B." Each station is formed of identical or mirror image components on opposite sides of the drive path so that each station has identical functionality regardless of the orientation of the carton 20. Referring to FIG. 2, carton 20' is depicted with the wide flap 27 to the left and the narrow flap 28 to the right while carton 20" is depicted with the wide flap to the right and the narrow flap to the left.

The components of the width adjustment station 40, the wide flap deflecting station 50, and the narrow flap closing station 60 on each side of the drive path "B" are secured together as a subassembly 30. In other words, the components that form one half of each of width adjustment station 40, wide flap deflecting station 50 and narrow flap closing station 60, are secured together as a subassembly and mounted on opposite sides of drive path "B." Each subassembly 30 is mounted at opposite ends of bridge 31 on linear bearings 32 to facilitate lateral movement of the subassemblies 30 relative to drive path "B" in order to compensate for cartons 20 of different widths.

Each subassembly 30 includes a generally U-shaped mounting bracket 33 having a first longer leg 34 and a second shorter leg 35 that is secured to linear bearing 32. The width adjustment station 40 includes a tapered carton guide 41 extending from the longer leg 34 of each U-shaped mounting bracket 33. The tapered carton guides 41 have a generally tapered or sloped inlet surface 42 facing the centerline of drive path "B" and a flat surface 43. The opposed inlet surfaces 42 form an inlet into which the cartons are funneled and the flat surfaces 43 act as guide surfaces that engage the sidewalls 21, 22 of the cartons 20 as the cartons pass through wide flap deflecting station 50 and the narrow flap closing station 60. The tapered carton guides 41 positioned on opposite sides of drive path "B" are substantially the mirror image of each other and are laterally aligned across the drive path "B."

The structures that form one half of the wide flap deflecting station 50 and the narrow flap closing station 60 extend from the end of the shorter leg 35 of the mounting bracket 33. More specifically, the wide flap deflecting station 50 includes a wide flap deflector block 51 that extends and tapers or slopes downward in a linear manner generally from the shorter leg 35 along each side of the drive path "B" in order to create a surface 52 that deflects or moves the wide flap downward and under narrow flap closer 61 as the carton 20 passes by the narrow flap closing station 60. The wide flap deflector block 51 has a flat surface 53 downstream of the downwardly sloped surface 52 for setting the amount of deflection of the wide flap. The wide flap deflector blocks 51 positioned on opposite sides of drive path "B" are substantially identical in shape and are laterally aligned across the drive path "B" in order to deflect the wide flap 27 downward regardless of the orientation of the carton 20. If desired, the sloped surface 52 of the flap deflector blocks 51 may be arcuate rather than linear.

The narrow flap closing station 60 includes a narrow flap closer 61 on both side of the centerline of drive path "B." Each narrow flap closer 61 includes a generally Z-shaped hanger arm 62 extending from the shorter leg 35 of U-shaped bracket 33 and has a narrow flap closing guide 63 mounted on the downstream (relative to drive path "B") end 64 thereof. Narrow flap closing guide 63 includes an arcuate section 65 having an arcuate, upwardly sloped edge 66 for engaging and deflecting the leading edge **28*a* of narrow flap 28 from a position at which the end thereof is outside the sidewall 21 to a position at which the end of the flap is between the sidewalls 21, 22 and above the cigarette packs. A linear section 67 is downstream from the arcuate section 66 and includes an upper section 67*a*, a sloped section 67*b* and an end section 67*c* that combine to guide the narrow flap 28 to its closed position. Arcuate section 65 and arcuate, sloped edge 66** could be linear provided that their shape causes the narrow flap to close or defect in the desired manner.

Figure 9:
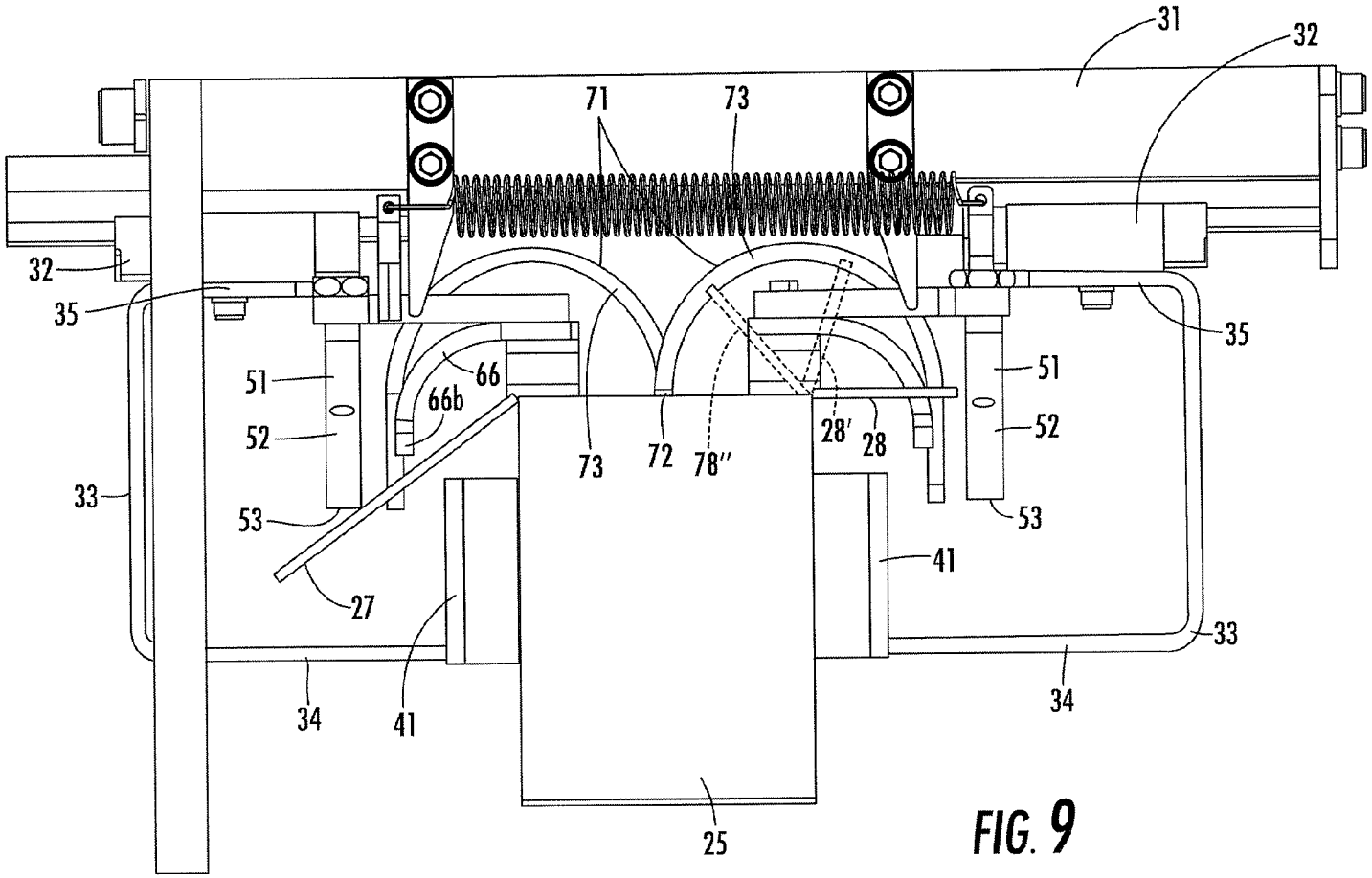
FIG. 9 is an end view of the flap closing and glue applying apparatus in the position depicted in FIG. 8 but with narrow flaps shown in different angular locations.
Figure 10:
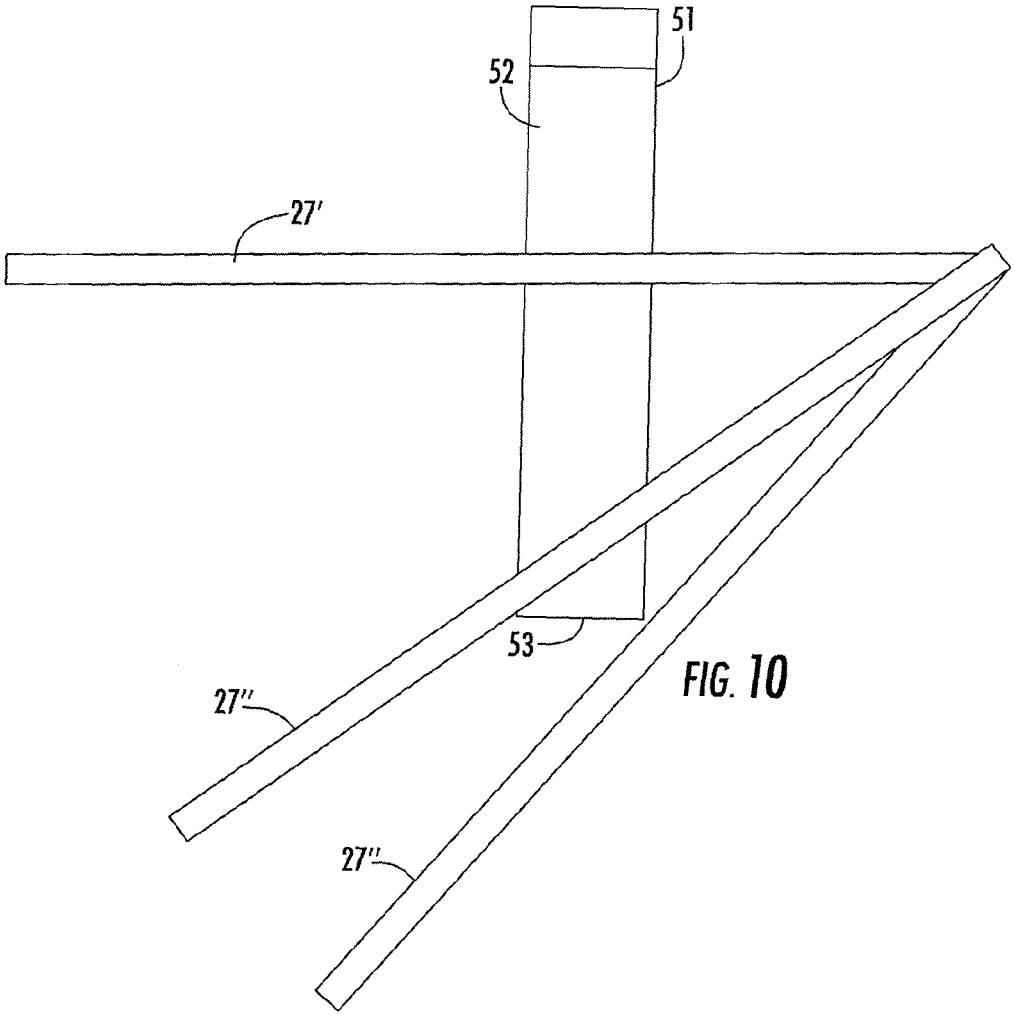
FIG. 10 is an enlarged end view of the wide flap deflector block and a wide flap shown in various angular orientations.

As the leading edge **28*a* of the narrow flap 28 passes the downstream end 66*a* (FIG. 11) of the arcuate, sloped edge 66, the narrow flap 28 slides under the linear section 67 and the upper surface of the narrow flap 28 slides along the inner edge of lower surface of the upper section 67*a* of linear section 67 in a linear manner generally parallel to the drive path until the leading edge 28*a* of the narrow flap 28 engages the inner edge of sloped section 67*b* which forces the leading edge of the flap downward until it eventually reaches the end section 67*c* of the linear section 67 of the narrow flap closing guide 63 which engages the narrow flap 28 and assists in holding the narrow flap in its closed position. More specifically, movement of the carton along drive path "B" causes the leading edge 28*a* of the narrow flap 28 to engage the arcuate sloped edge 66 of arcuate section 65 generally adjacent a lower section 66*b* thereof. The lower section 66*b* of the arcuate section 65 is positioned sufficiently above the flat surface 53 of wide flap deflector block 51 so that the wide flap 27 does not engage the narrow flap closing guide (FIG. 9). As the narrow flap 28 travels along the sloped edge 66, it initially moves the free end of the flap upward so that the narrow flap 28 is eventually parallel to sidewall 21 and finally rotates the leading edge 28***a* of the narrow flap so that it slides under linear section 67. The narrow flap 28 is depicted in FIGS. 9-11 at an initial position at which the narrow flap initially engages sloped edge 66, at an intermediate position 28' and at the position 28" at which the narrow flap passes the sloped edge 66. The leading edge 28*a* of the narrow flap 28 follows the inside edge of the contour of linear section 67 until the narrow flap is generally perpendicular to sidewalls 21. 22 of carton 20. The narrow flap closers 61 positioned on opposite sides of drive path "B" are substantially the mirror image of each other and are laterally aligned across the drive path "B" so that the small flap will be closed regardless of the orientation of the carton 20.

The subassemblies 30 that form one half of each of width adjustment station 40, wide flap deflecting station 50 and narrow flap closing station 60 are configured to move laterally in opposite directions depending on the width of the carton passing through the machine 10. For example, the distance between the flat surfaces 43 of tapered carton guides 41 is set so as to match the minimum width of the narrowest carton 20 that will pass through machine 20. Wider cartons will engage and slide along the sloped inlet surfaces 42 which will cause the tapered carton guides 41, and thus the U-shaped brackets 33, to move laterally relative to drive path "B." The lateral movement of U-shaped brackets 33 will likewise cause the wide flap deflector blocks 51 and the narrow flap closer 61 to move laterally and thus position each of those structures at their correct lateral positions. A spring 36 is provided to bias the two subassemblies towards the centerline of the drive path "B" so that the machine is always configured for the narrowest size carton.

Glue station 55 includes a pair of glue nozzles 57 positioned immediately downstream from each end section 67*c* of the narrow flap closing guides 63 to form a pair of glue nozzles 57 that are laterally aligned and positioned on opposite sides of the centerline of drive path "B." The glue nozzles are connected to a control system that is also connected to a sensor that determines on which side of carton 20 the wide flap 27 is located so that glue is only dispensed from the nozzle aligned with the narrow flap 28.

Figure 13:
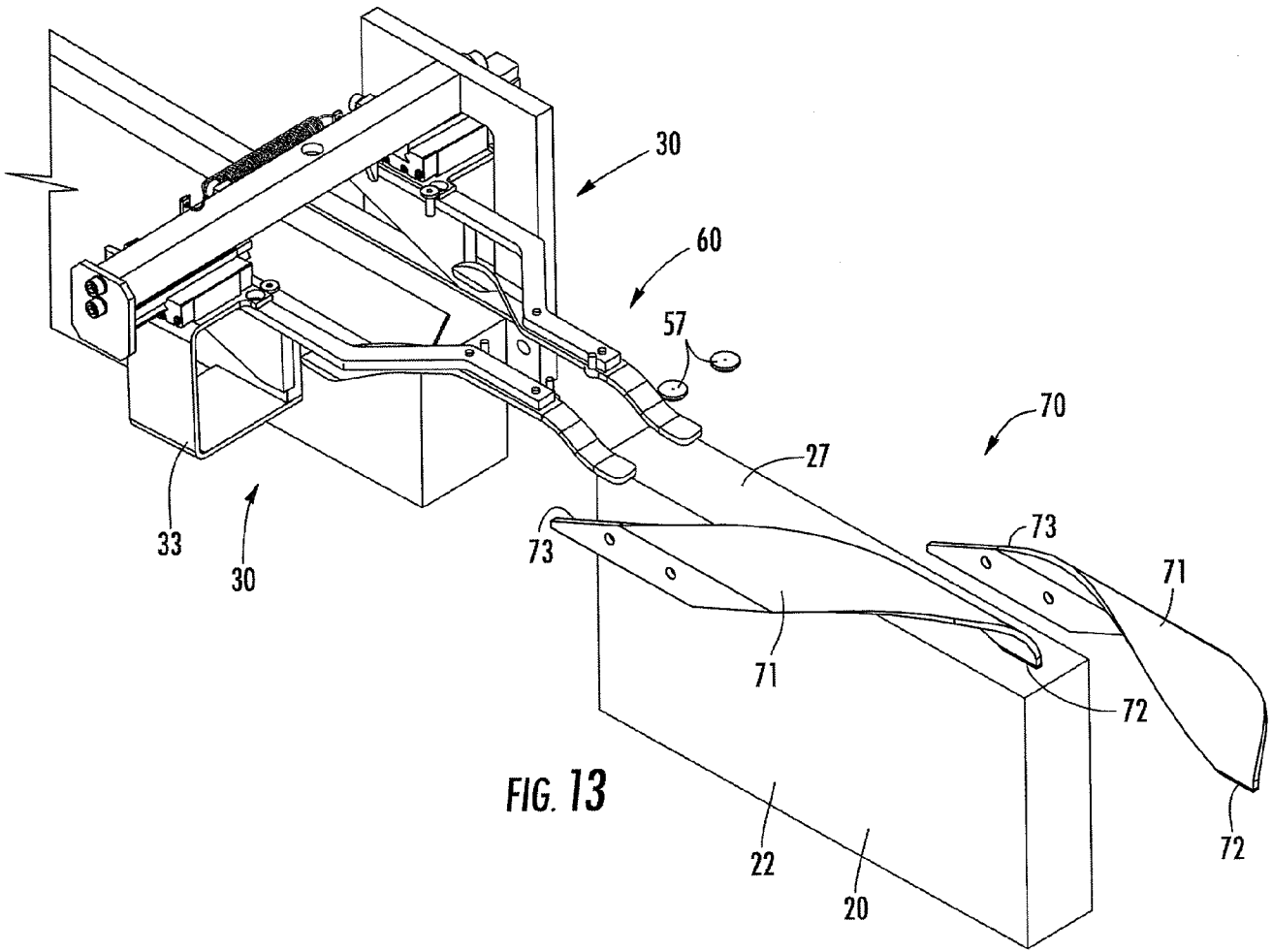
FIG. 13 is an enlarged perspective view of a portion of the flap closing and glue applying apparatus of FIG. 2 depicting a narrow carton passing through the wide flap closing station.

Referring to FIGS. 2 and 13, the wide flap closing station 70 includes a pair of generally arcuate guides 71 located downstream from glue nozzles 57. Each arcuate guide 71 is generally arcuate and elongated along the drive path "B" so as to be somewhat in the shape of a length of a spiral or a helix. The spiral shape ends in a flat surface or edge 72 that is generally parallel to the top surface of carton 20 and is positioned generally along the centerline of the drive path. The guide section has tapered or arcuate sloped edge or surface 73 that engages the leading edge 27*a* of the wide flap 27 generally adjacent the lower edge of the sloped surface. Movement of the carton along drive path "B" causes the leading edge 27*a* of the wide flap 27 to travel along the sloped surface 73. As the wide flap 27 travels along the sloped surface, it initially moves the free end of the flap upward so that the wide flap is eventually parallel to sidewall 22. Wide flap 27 continues to travel along sloped surface 73 as the carton moves along drive path "B" until the end of wide flap 27 moves downward to position the wide flap on top of narrow flap 28. The flat surface 72 of arcuate guide 71 presses the wide flap onto the narrow flap 28 so that the adhesive engages the wide and narrow flaps 27, 28 together to seal the carton 20. Guide section 71 and arcuate sloped surface 73 could be linear provided that their shape causes the wide flap to close or defect in the desired manner. The arcuate guides 71 located on opposite sides of drive path "B" are substantially the mirror image of each other and are offset from each other along the drive path "B" because the flat surfaces 72 extend to the centerline of the drive path and would interfere with each other if the arcuate guides 71 were not offset along the drive path.

Each of the components of subassemblies 30 and wide flap closing station 70 may be made of a strong, durable material such as steel, aluminum or other metals as well as some plastic materials. In addition, it may be desirable to form the width adjustment blocks out of a softer material such as nylon or other similar materials to reduce the likelihood of damaging cartons or cigarette packs as they are processed through flap closing and glue applying apparatus 16.

In operation, a series of cartons 20 are removed from a box and placed on feed conveyor 12 of revenue stamp applying machine 10 with top wall 24 facing upward. The left or right orientation of wide flap 27 and narrow flap 28 does not matter as long as top wall 24 faces upward and the longitudinal axis of carton 20 extends in a direction generally parallel to drive path "B." The individual cartons are fed by the feed conveyor 12 from the loading station to the drive conveyor 13 at which point the longitudinal axis of each carton 20 is aligned with drive path "B." Drive conveyor 13 moves carton 20 along the drive path towards and past opening member 15 in order to open each carton and expose the bottom of each pack of cigarettes. Opening member 15 is configured to open the cartons regardless of the left or right orientation of the wide and narrow flaps 27, 28 of cartons 20 but a sensor (not shown) may be provided generally adjacent the opening member or at some other desired location in order to determine the orientation of the wide and narrow flaps for subsequently controlling the re-sealing process. The cartons 20 then pass the stamp head 14 and revenue stamps are applied to each pack of cigarettes within the open carton.

Drive conveyor 13 then moves the cartons towards flap closing and glue applying apparatus 16. Spring 36 is configured to bias the tapered carton guides 41, the U-shaped mounting brackets 33, the wide flap deflector blocks 51 and the narrow flap closers 61 towards each other so that the flat surfaces 43 of carton guides 41 are initially spaced a minimum distance apart. If a carton 20 passing through the flap closing and glue applying apparatus 16 has a lateral dimension equal to the minimum distance between carton guides, the carton guides 41, the U-shaped mounting brackets 33, the wide flap deflector blocks 51 and the narrow flap closers 61 will all remain in their original, undisplaced position as shown in FIGS. 2, 4, 5. If the carton is wider than the minimum distance, the leading edge 20*a* of carton 20 will engage the tapered inlet surface 42 of each tapered carton guide 41 which will force both carton guides 41 outward away from the centerline of the drive path. Since the carton guides 41 are connected to the U-shaped mounting brackets 33 and the mounting brackets are connected to the wide flap deflector blocks 51 and the narrow flap closers 61, lateral movement of the carton guides 41 also moves laterally the wide flap deflector blocks and the narrow flap closers. The carton guides 41, the U-shaped mounting brackets 33, the wide flap deflector blocks 51 and the narrow flap closers 61 are all dimensioned so that lateral movement of the carton guides will move the wide flap deflector blocks and the narrow flap closer to the proper lateral positions relative to the drive path "B" and the centerline of the carton 20.

Figure 6:
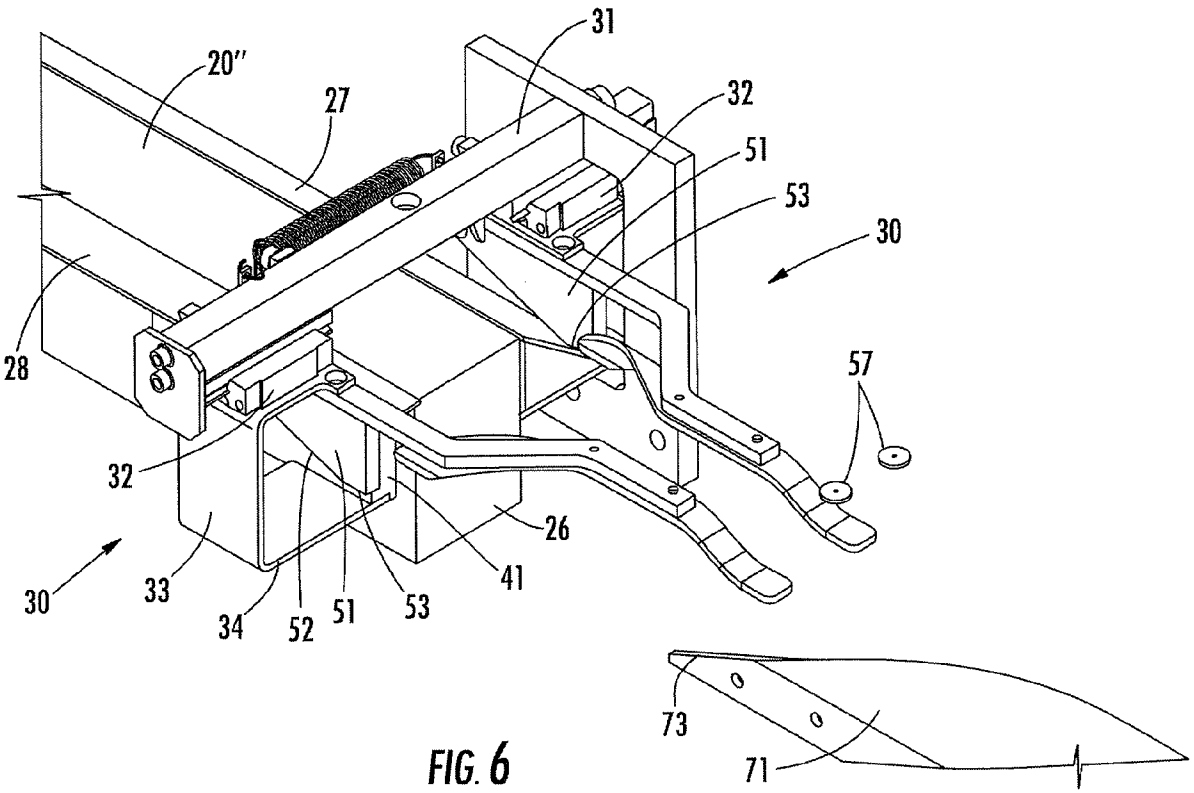
FIG. 6 is an enlarged perspective view of a portion of the flap closing and glue applying apparatus similar to FIG. 2 but with a carton engaging the width adjustment station and having a wide flap deflected downward.
Figure 7:
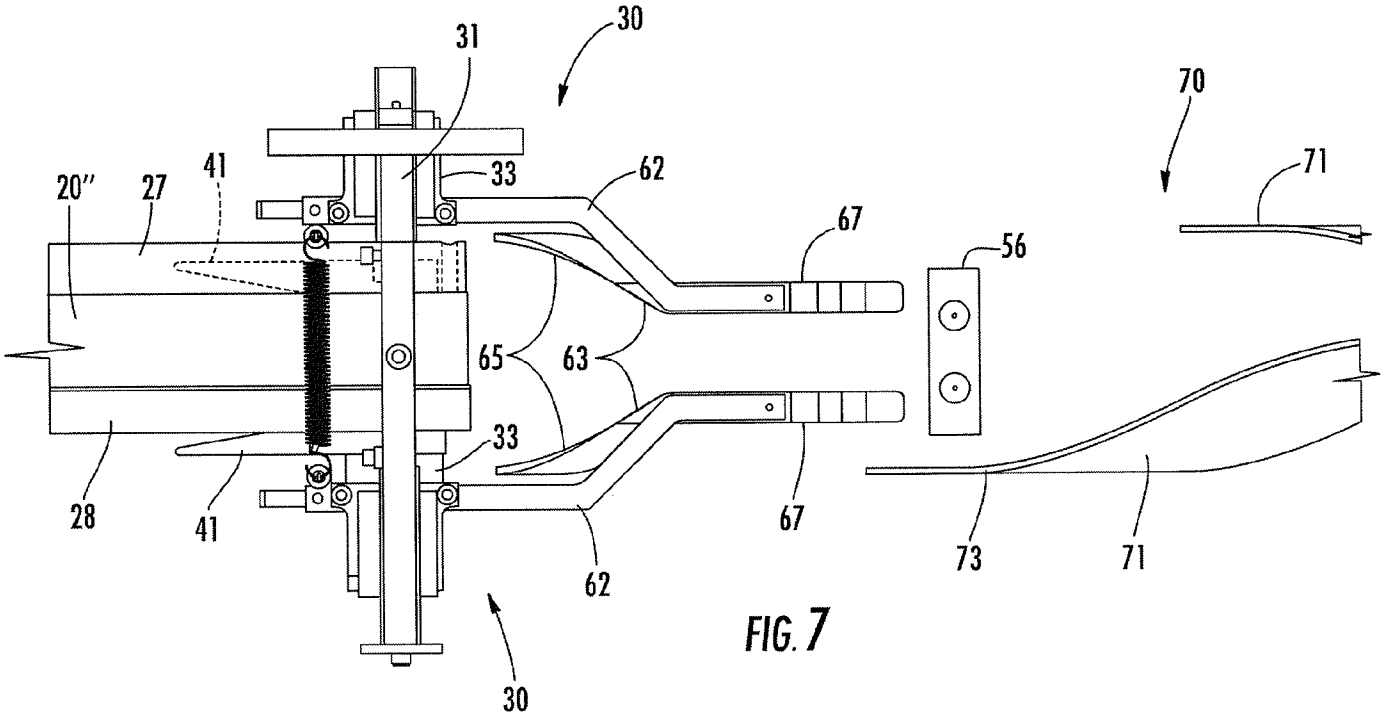
FIG. 7 is a top plan view of the flap closing and glue applying apparatus in the position depicted in FIG. 6.
Figure 8:
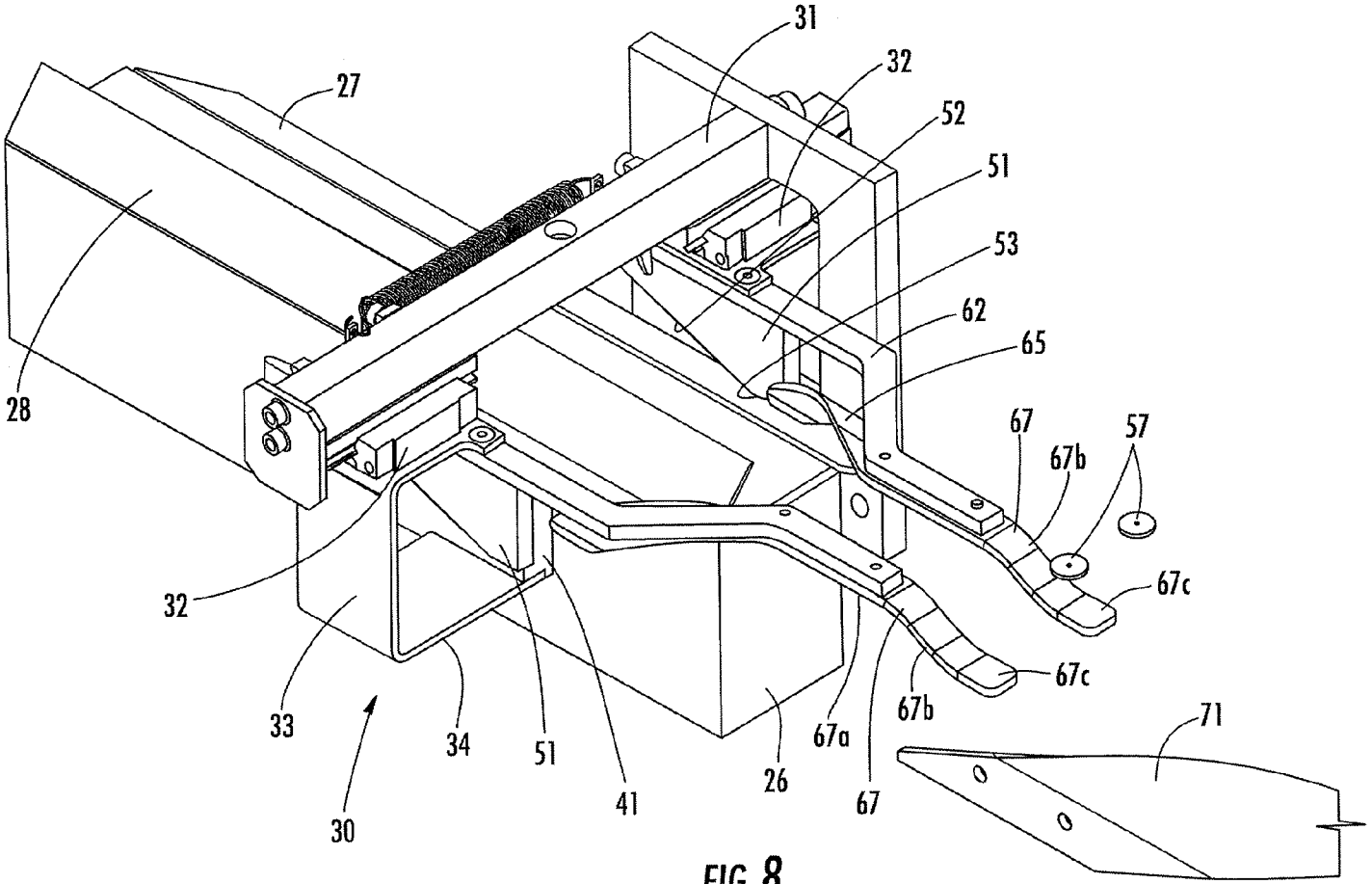
FIG. 8 is an enlarged perspective view of the flap closing and glue applying apparatus similar to FIG. 6 but with a narrow flap partially closed.

Referring to FIGS. 6, 7, as the carton 20 continues along drive path "B," the wide flap 27 engages the downwardly facing sloped surface 52 of the wide flap deflector block 51 that is located on the side of carton 20 having the wide flap 27. The leading edge 27*a* of the wide flap 27 will initially engage the sloped surface 52 generally towards the upstream end thereof and then slide down the sloped surface so that the entire wide flap 27 is displaced downward below the bottom or flat surface 53 of the wide flap deflector. FIG. 10 depicts that wide flap 27 sliding along deflector block 51 from a position in which the wide flap 27 is approximately horizontal, to a lower position 27' near the lower edge of sloped surface 52 and at a third position 27" at which the wide flap is located below the deflector block and guided by the inner surface of the bottom surface 53. The wide flap 27 is displaced downward a sufficient distance so that it does not engage the narrow flap closer 51 on the side of carton 20 having the wide flap 27. In other words, the wide flap deflector block 51 maintains the wide flap 27 at a position beneath the narrow flap closer 61 until the wide flap has passed by the narrow flap closer.

While the wide flap 27 is being held by the wide flap deflector block 51 beneath the narrow flap closer 61 positioned on the same side of carton 20, the narrow flap 28 approaches the narrow flap closer 61 located on the same side of carton 20 (FIG. 9), as the narrow flap. The leading edge 28*a* of the narrow flap 28 engages the arcuate, sloped edge 66 of arcuate section 65 of narrow flap closing guide 61 generally adjacent a lower portion thereof. As the carton 20 moves along drive path "B," the leading edge 28*a* of narrow flap 28 slides from an initial position at which the narrow flap 28 is located outside the sidewall 21 of the carton (FIGS. 9, 11, 12) and along the sloped edge 66 of narrow flap closing guide 61 until the flap is generally parallel to the sidewall 21 and continues until the narrow flap 28 slides under linear section 67 of the closing guide. The leading edge 28*a* of the narrow flap 28 as well as the rest of the narrow flap 28 slide along the inner or lower surface of the linear section 67 and are forced downward by sloped section 67*b* towards a plane that connects the top edges of the sidewalls 21, 22 in order to close the narrow flap 28. The end section 67*c* of linear section 67 generally holds the narrow flap 28 in its closed position as the carton continues to slide along drive path "B." Based upon information provided by the sensor as to the location of the wide and narrow flaps, a control system provides a signal to the glue nozzle to dispense the appropriate amount of glue from the nozzle aligned with the narrow flap 28.

Figure 12:
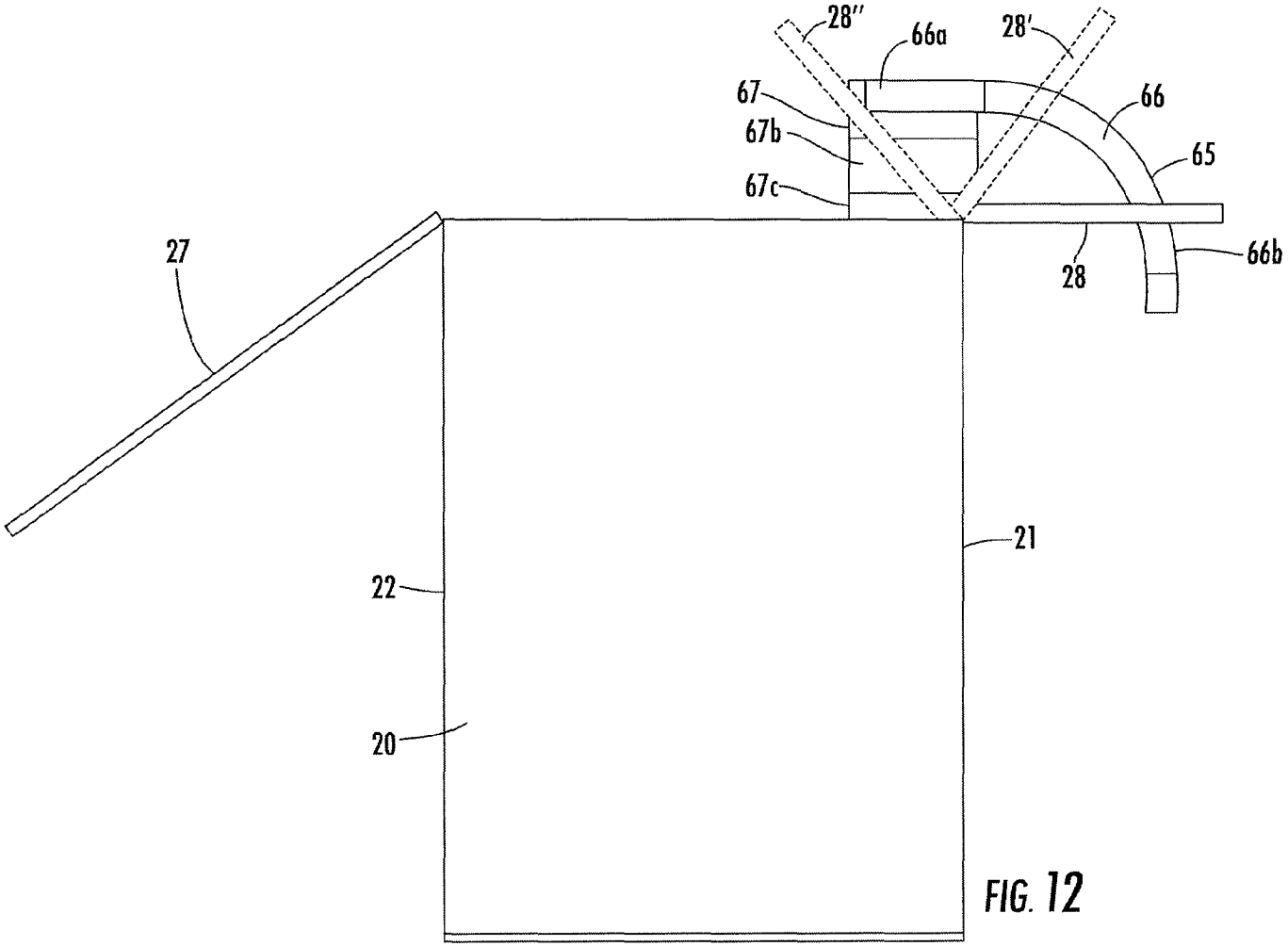
FIG. 12 is an end view similar to FIG. 11 but also showing a carton together with a wide flap.

As the drive conveyor 13 continues to move carton 20 along the drive path, the leading edge 27*a* of the wide flap 27 approaches the wide flap closing station 70. The wide flap 27 will tend to spring back upward as it moves past the wide flap deflector block 51 and the leading or upstream edge 73*a* of the wide flap closer is positioned low enough so the leading edge 27*a* of the wide flap 27 will engage the sloped, arcuate edge 73 of arcuate guides 71 generally adjacent a lower portion thereof. As the carton 20 moves along drive path "B," the leading edge 27*a* of wide flap 27 slides from an initial position at which the wide flap 27 is located outside the sidewall 22 of the carton along the sloped edge 73 of wide flap closing guide 71 past the point at which the flap is generally parallel to the sidewall 22 and continues to the downstream edge of the arcuate guide section. This movement is similar to the closing movement of narrow flap 28 as depicted in FIGS. 9, 11, 12. As the wide flap 27 passes the downstream edge of the arcuate guide section, the leading edge 27*a* of the wide flap slides under flat surface 72 of the closing guide 71 to press the wide flap 27 onto the narrow flap 28 and causes the adhesive on the narrow flap to engage the upper flap and seal the carton.

Alternative embodiments could utilize a single narrow flap closer and a single wide flap closer that are moved to opposite sides of the carton based upon on the orientation of the narrow and wide flaps on the carton that is sensed upstream of the flap closing apparatus. Another alternative could utilize a pair of narrow flap closers and a pair of wide flap closers without using a wide flap deflector. This could be accomplished by determining the orientation of the narrow and wide flaps and then moving one of narrow flap closers into the path of the narrow flap and moving the wide flap closer located on the opposite side of the drive path into the path of the wide flap. In an instance in which the carton is oriented with the narrow and wide flaps extending in the opposite directions, the narrow flap closer from the opposite side of the drive path would be moved into the path of the narrow flap and the wide flap deflector from the opposite side of the drive path would be moved into the path of the wide flap.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A method of processing a rectangular cuboid, comprising the steps of:

providing first and second rectangular cuboids, each cuboid having first and second oppositely facing side surfaces generally parallel to a longitudinal axis of the cuboid, first and second flaps extending from edges of the first and second side surfaces, respectively, the first flap being shorter than the second flap, and a plane through the edges defining a generally planar open face of the cuboid;

providing a closing apparatus along a generally linear drive path to move each flap from an open position to a closed position to close the open face, the closing apparatus having a pair of first flap closing guides;

orienting the first cuboid in a first orientation with the longitudinal axis thereof being parallel to the drive path, the first side surface of the first cuboid being positioned in a first direction relative to the drive path and the open face being oriented in a second direction relative to the drive path;

orienting the second cuboid in a second orientation with the longitudinal axis thereof being parallel to the drive path, the first side surface of the second cuboid being positioned in a third direction relative to the drive path and the open face being oriented in the second direction relative to the drive path, the first direction being opposite to the third direction;

moving the first cuboid in an automated manner relative to the closing apparatus along the drive path, moving a first of the first flap closing guides to a desired position based upon a width of the first cuboid, whereby linear movement of the first cuboid along the drive path causes the closing apparatus to engage the first and second flaps of the first cuboid to close the first cuboid; and moving the second cuboid in an automated manner relative to the closing apparatus along the drive path, moving a second of the first flap closing guides to a desired position based upon a width of the second cuboid, whereby linear movement of the second cuboid along the drive path causes the closing apparatus to engage the first and second flaps of the second cuboid to close the second cuboid.

2. The method of claim 1, further including the step of applying indicia to articles within the first and second cuboids before the moving steps.

3. The method of claim 1, further including the step of applying adhesive to the first flap of the first and second cuboids after the first flap has been closed but before the second flap has been closed.

4. The method of claim 1, wherein the closing apparatus engages the first flap of the first cuboid to rotate the first flap relative to the first side surface and subsequently engages the second flap of the first cuboid to rotate the second flap relative to the second side surface.

5. The method of claim 4, further including applying an adhesive to the first flap before rotating the second flap,

6. The method of claim 4, wherein the first flap and the second flap are rotated so as to be positioned generally coplanar with the generally planar open face of the first cuboid.

7. The method of claim 1, further including laterally moving at least a portion of the closing apparatus away from the drive path prior to closing the first flap of the first cuboid.

8. The method of claim 1, wherein the laterally moving step includes moving one of the first flap closing guides laterally to align the first flap closing guide with the first flap of the first cuboid and moving a second flap deflector block laterally to align the second flap deflector block with the second flap of the first cuboid.

9. The method of claim 8, further including engaging the first cuboid with a tapered carton engaging member to laterally move the first flap closing guide and the second flap closing guide.

10. The method of claim 8, further including guiding with a second flap deflector block the second flap of the first cuboid away from a first flap closing guide prior to engaging the first flap with the first flap closing guide.

11. A method. of processing a rectangular cuboid, comprising the steps of:

providing first and second rectangular cuboids, each cuboid having first and second oppositely facing side surfaces generally parallel to a longitudinal axis of the cuboid, first and second flaps extending from edges of the first and second side surfaces, respectively, the first flap being shorter than the second flap, and a plane through the edges defining a generally planar open face of the cuboid;

providing a closing apparatus along a drive path to move each flap from an open position to a closed position generally along the open face, the closing apparatus having a pair of first flap closing guides, and a pair of second flap closing guides;

orienting the first cuboid in a first orientation with the longitudinal axis thereof being parallel to the drive path, the first side surface of the first cuboid being positioned in a first direction relative to the drive path and the open face being oriented in a second direction relative to the drive path;

orienting the second cuboid in a second orientation with the longitudinal axis thereof being parallel to the drive path, the first side surface of the second cuboid being positioned in a third direction relative to the drive path and the open face being oriented in the second direction relative to the drive path, the first direction being opposite to the third direction;

moving the first cuboid in an automated manner relative to the closing apparatus along the drive path, moving a first of the first flap closing guides to a desired position based upon a width of the first cuboid, whereby the movement of the first cuboid along the drive path causes the first flap of the first cuboid to engage the first of the first flap closing guides to move the first flap of the first cuboid into a sealed position generally along the open face of the first cuboid, and further causes the second flap of the first cuboid to engage a first of the second flap closing guides to move the second flap of the first cuboid into a sealed position generally along the open face of the first cuboid to at least partially form a first surface of the first cuboid; and moving the second cuboid in an automated manner relative to the closing apparatus along the drive path, moving a second of the first flap closing guides to a desired position based upon a width of the second cuboid, whereby the movement of the second cuboid along the drive path causes the first flap of the second cuboid to engage the second of the first flap closing guides to move the first flap of the second cuboid into a sealed position generally along the open face of the second cuboid, and further causes the second flap of the second cuboid to engage a second of the second flap closing guides to move the second flap of the second cuboid into a sealed position generally along the open face of the second cuboid to at least partially form a first surface of the second cuboid.

12. The method of claim 11, further including the step of applying indicia to articles within the first and second cuboids before the moving steps.

13. The method of claim 11, further including the step of applying adhesive to the first flap of the first and second cuboids after the first flap has been closed but before the second flap has been closed.

14. The method of claim 11, wherein the closing apparatus engages the first flap of the first cuboid to rotate the first flap relative to the first side surface and subsequently engages the second flap of the first cuboid to rotate the second flap relative to the second side surface.

15. The method of claim 14, further including applying an adhesive to the first flap before rotating the second flap.

16. The method of claim 14, wherein the first flap and the second flap are rotated so as to be positioned generally coplanar with the generally planar open face of the first cuboid.

17. The method of claim 11, further including laterally moving at least a portion of the closing apparatus away from the drive path prior to closing the first flap of the first cuboid.

18. The method of claim 17, wherein the laterally moving step includes moving a one of the first flap closing guides laterally to align the first flap closing guide with the first flap of the first cuboid and moving a second flap deflector block laterally to align the second flap deflector block with the second flap of the first cuboid.

19. The method of claim 18, further including engaging the first cuboid with a tapered carton engaging member to laterally move the first flap closing guide and the second flap closing guide.

20. The method of claim 11, further including engaging and guiding the second flap of the first cuboid with a second flap deflector block away from a first flap closing guide prior to engaging the first flap with the first flap closing guide.

* * * * *